United States Patent [19]

Ito

[11] 4,391,253

[45] Jul. 5, 1983

[54] ELECTRONICALLY CONTROLLING, FUEL INJECTION METHOD

[75] Inventor: Sumio Ito, Gotenba, Japan

[73] Assignee: Toyota Jidosha Kogyo Kabushiki Kaisha, Toyota, Japan

[21] Appl. No.: 257,132

[22] Filed: Apr. 24, 1981

[30] Foreign Application Priority Data

Oct. 29, 1980 [JP] Japan ..... 55-150627
Oct. 30, 1980 [JP] Japan ..... 55-151390

[51] Int. Cl.[3] ..... F02D 37/02

[52] U.S. Cl. ..... 123/478; 123/417; 123/480; 123/489

[58] Field of Search ..... 123/489, 480, 486, 416, 123/417, 1 A, 478, 415

[56] References Cited

U.S. PATENT DOCUMENTS

| | | | |
|---|---|---|---|
| 4,200,064 | 4/1980 | Engele | 123/489 |
| 4,201,161 | 5/1980 | Sasayama et al. | 123/489 |
| 4,235,204 | 11/1980 | Rice | 123/489 |
| 4,257,377 | 3/1981 | Kinugawa et al. | 123/480 |
| 4,306,529 | 12/1981 | Chiesa et al. | 123/489 |
| 4,325,329 | 4/1982 | Taylor | 123/1 A |

FOREIGN PATENT DOCUMENTS

| | | | |
|---|---|---|---|
| 7712689 | 5/1979 | Netherlands | 123/1 A |

OTHER PUBLICATIONS

Road & Track, 9/1975, pp. 122–123, "Technical Correspondence with the Engineering Editor".

*Primary Examiner*—Charles J. Myhre
*Assistant Examiner*—Andrew M. Dolinar
*Attorney, Agent, or Firm*—Cushman, Darby & Cushman

[57] ABSTRACT

In an electronically controlling, fuel injection method, wherein an electromagnetic fuel injection valve is controlled so as to control an amount of alcohol-containing-fuel being supplied into an intake system, a difference between a basic amount of fuel being injected and an actual amount of fuel being injected, or a ratio of the former to the latter, is stored in closed loop controlling in which an actual amount of fuel being injected is calculated by using air-fuel-ratio-feedback signals as parameters, the aforesaid basic amount of fuel being injected being calculated from operational parameters of the engine, besides an air-fuel ratio, and the aforesaid actual amount of fuel being injected being calculated by correcting the basic amount of fuel being injected on the basis of air-fuel-ratio-feedback signals; and the basic amount of fuel being injected is corrected on the basis of the aforesaid difference or ratio in open loop controlling, thereby calculating the actual amount of fuel being injected.

11 Claims, 5 Drawing Figures

ELECTRONICALLY CONTROLLING, FUEL INJECTION METHOD

BACKGROUND OF THE INVENTION

1. Field of the Invention

This invention relates to an electronically controlling, fuel injection method for an automotive engine, in which a gasoline fuel containing alcohol is employable.

2. Description of the Prior Art

Alcohol and gasoline differ from each other in a stoichiometric air-fuel ratio. For this reason, when a gasoline fuel containing alcohol is used, there occurs divergence in an air-fuel ratio from a required value, particularly in open loop controlling in which an air-fuel-ratio-feedback signal is cut off, such as during the warming-up of an engine and when a throttle valve assumes a fully open position. This leads to the lowered operational performance of the engine as well as an increased amount of detrimental constituents released to atmosphere.

Furthermore, in an electrostatic capacity type alcohol sensor for detecting a concentration of alochol in a fuel, an output of the sensor fluctuates due to alcohol as well as due to impurity, such as water, and its output tends to change with the lapse of time. Due to these factors, a proper air-fuel ratio is hardly obtainable, although an amount of fuel being injected is calculated on the basis of a concentration of alcohol.

SUMMARY OF THE INVENTION

It is a primary object of the present invention to provide an electronically controlling, fuel injection method, wherein there are avoided the lowering in operational performance of an engine and/or increase in an amount of detrimental constituents being released to atmosphere, in open loop controlling, independently of a concentration of alcohol in a fuel.

It is a secondary object of the present invention to provide an electronically controlling, fuel injection method, wherein a proper amount of fuel being injected, which is related to a concentration of alcohol, is obtained, irrespective of fluctuation in output of the alcohol sensor which is caused by impurities or which takes place with the lapse of time.

To attain the primary object, there is provided according to the present invention a fuel injection method which comprises the steps of storing a difference between a basic amount of fuel injected and an actual amount of fuel injected or a ratio of the former to the latter, in closed loop controlling, the aforesaid basic amount of fuel being injected being calculated on the basis of operational parameters of an engine, and the aforesaid actual amount of fuel injected being determined by correcting the basic amount of fuel injected according to an air-fuel-ratio-feedback signal; and determining an actual amount of fuel injected by correcting the basic amount of fuel injected according to the aforesaid difference or ratio, in open loop controlling. When a fuel of the same type is used both in closed loop controlling and in open loop controlling, the difference between the basic amount of fuel being injected and an actual amount of fuel being injected, which is required for an engine, or the ratio of the former to the latter, in closed loop controlling, is substantially equal to the difference or ratio in open loop controlling, independently of a concentration of alcohol in a fuel. From this fact, an actual amount of fuel being injected is determined by correcting a basic amount of fuel being injected in open loop controlling, on the basis of the aforesaid difference or ratio in closed loop controlling, whereby an air-fuel ratio in open loop controlling is maintained at a proper value in relation to a concentration of alcohol, with the result of the improved operational performance of an engine, reduction of an amount of harmful constituents released to atmosphere and reduction of a fuel cost.

In order to calculate a basic amount of fuel being injected, an engine running speed and a flow rate of intake air are selected as operational parameters of the engine. The aforesaid difference or ratio is stored, for example, in a memory connected to a backup power source, which memory can hold therein such a value even when an ignition switch for an engine is turned off. By such arrangements, an amount of fuel being injected can be controlled even for a duration of the subsequent warming-up of the engine after the engine is stopped by the turning-off of the ignition switch for the engine. Preferably, a value obtained by adding the aforesaid difference or a given value to the basic amount of fuel being injected is considered as an actual amount of fuel being injected, or a value obtained by multiplying the basic amount of fuel being injected by the aforesaid ratio is adapted as an actual amount of fuel being injected. The actual amount of fuel being injected is dependent on a concentration of alcohol. Preferably, the aforesaid difference or ratio is used as a parameter for calculating a basic ignition timing, so that the ignition timing can be varied according to a concentration of alcohol. Preferably, the basic ignition timing is a minimum advance for best torque in the case where a pure gasoline fuel is employed, and an actual ignition timing makes earlier, with increase in a concentration of alcohol in the fuel. The engine output is thus increased, a fuel cost is curtailed, and an amount of harmful constituents released to atmosphere is decreased.

To attain the secondary object, a difference between a basic amount of fuel being injected and an actual amount of fuel being injected is stored, and the output of an alcohol sensor is corrected on the basis of the aforesaid difference, the aforesaid basic amount of fuel being injected being calculated according to operational parameters of an engine and a concentration of alcohol in a fuel, which is detected by an alcohol sensor, and the aforesaid actual amount of fuel being injected being obtained by correcting the basic amount of fuel being injected on the basis of an actual air-fuel ratio of a mixture charge. The basic amount of fuel being injected is calculated according to a corrected output of the alcohol sensor, stated otherwise, according to a value substantially equal to an actual concentration of alcohol, independently of fluctuation of an output of alcohol sensor, so that a proper air-fuel ratio dependent on a concentration of alcohol may be obtained.

Preferably, an engine running speed and a flow rate of intake air are selected as operational parameters of the engine for calculation of a basic amount of fuel being injected. Furthermore, the aforesaid difference is stored in a means adapted for holding therein the memory even after the engine ignition switch has been turned off, for example, in a memory connected to a backup power source. The electronically controlling method according to the present invention starts immediately after recommencement of the running of the engine subsequent to the interruption of the running of the engine by the turning-off of the ignition switch. It should preferably be defined that K=actual amount of fuel being injected—basic amount of fuel being injected; and that if K is positive, an output of the alcohol sensor is so corrected as to be shifed by an extent proportional to K or by a given value to a direction to increase a concentration of alcohol, and if K is negative, the output of the alcohol sensor is so corrected as to be shifted by an extent proportional to K or by a given value to a direction to decrease a concentration of alcohol.

Preferably, the aforesaid corrected output of the alcohol sensor is utilized for calculation of an ignition timing. An ignition timing related to substantially a correct concentration of alcohol in a fuel is thus calculated, with the result that the output of the engine is increased, a fuel cost is reduced, and a reduced amount of nitrogen oxides is produced.

DESCRIPTION OF THE PREFERRED EMBODIMENTS

Figure 1:
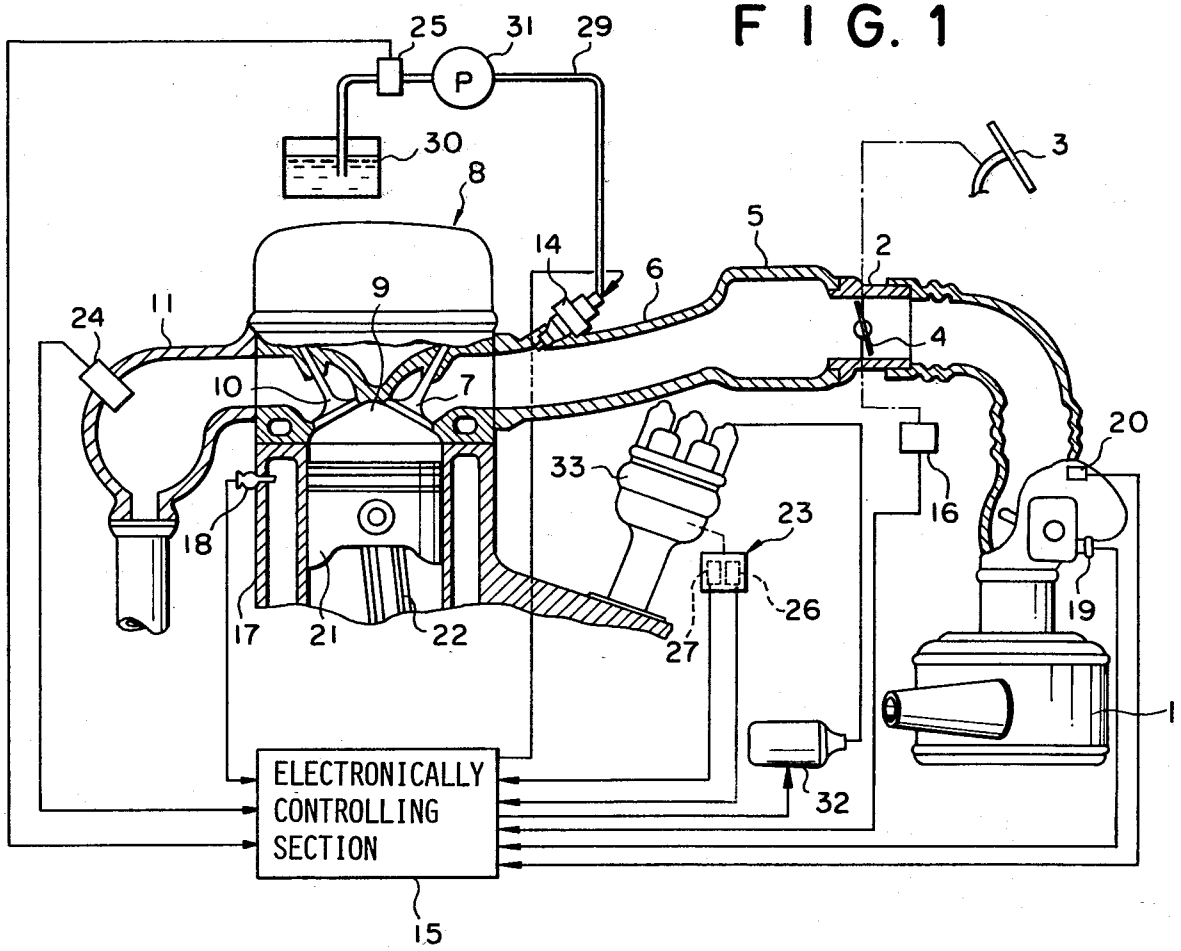
FIG. 1 is a schematic view of an electronically controlled, fuel injection device to which the method according to the present invention is applied.

Description will start with the outline of an electronically controlling, fuel injection device to which the method of the present invention is applied, in conjunction with FIG. 1. Air drawn under suction from an air cleaner 1 is supplied via a surge tank 5, an intake manifold 6 and an intake valve 7 into combustion chambers 9 in an engine body 8, while a flow rate of air is being controlled by a throttle valve 4 provided in a throttle body 2 and interlocking with an acceleration pedal 3 in a driver's room. A mixture charge burnt in the combustion chambers 9 is released in the form of exhaust gases to atmosphere via an exhaust valve 10 and an exhaust manifold 11. An electromagnetic fuel injection valve 14 is provided in the intake manifold in an opposed relation to respective combustion chamber 9. An electronically controlling section 15 receives input signals from such components as a throttle switch 16 for detecting the throttle valve 2 turned to the fully closed position, a water-temperature sensor 18 attached to a water jacket 17 in the engine body 8, an air flow-meter 19 provided between the air cleaner 1 and the throttle valve 4 so as to detect a flow rate of intake air, an intake-air temperature sensor 20 for detecting a temperature of intake air, a rotational angle sensor 23 for detecting an angle of rotation of a distributor shaft decelerated in rotation to one-half and connected to a crank shaft, in order to detect an angle of rotation of the crank shaft connected through the medium of a connecting rod 22 to a piston 21, and an air-fuel-ratio sensor 24 provided in the exhaust manifold 11 and detecting a concentration of oxygen in exhaust gases. The rotational angle sensor 23 has a portion 26 adapted for producing a single pulse per two revolutions of the crank shaft, and a portion 27 adapted for producing a single pulse at every predetermined angle of crank shaft, for example, at every 30°. A fuel is supplied by a fuel pump 31 from a fuel tank 30 via a fuel line 29 into the fuel injection valve 14. An alcohol sensor 25 for detecting a concentration of alcohol in the fuel line is provided on the fuel line 29, and the output of the alcohol sensor 25 is also transmitted to the electronically controlling section 15. The electronically controlling section 15 calculates an amount of fuel being injected and a fuel injection timing on the basis of various input signals fed thereto, thereby transmitting fuel injection pulses to the fuel injection valve 14. The electronically controlling section also calculates an ignition timing, thereby transmitting signals to an ignition coil 32. A secondary current of the ignition coil 32 is supplied to a distributor 33. The fuel injection valve 14 is maintained at an open position only for a duration which the valve receives pulses from the electronically controlling section.

Figure 2:
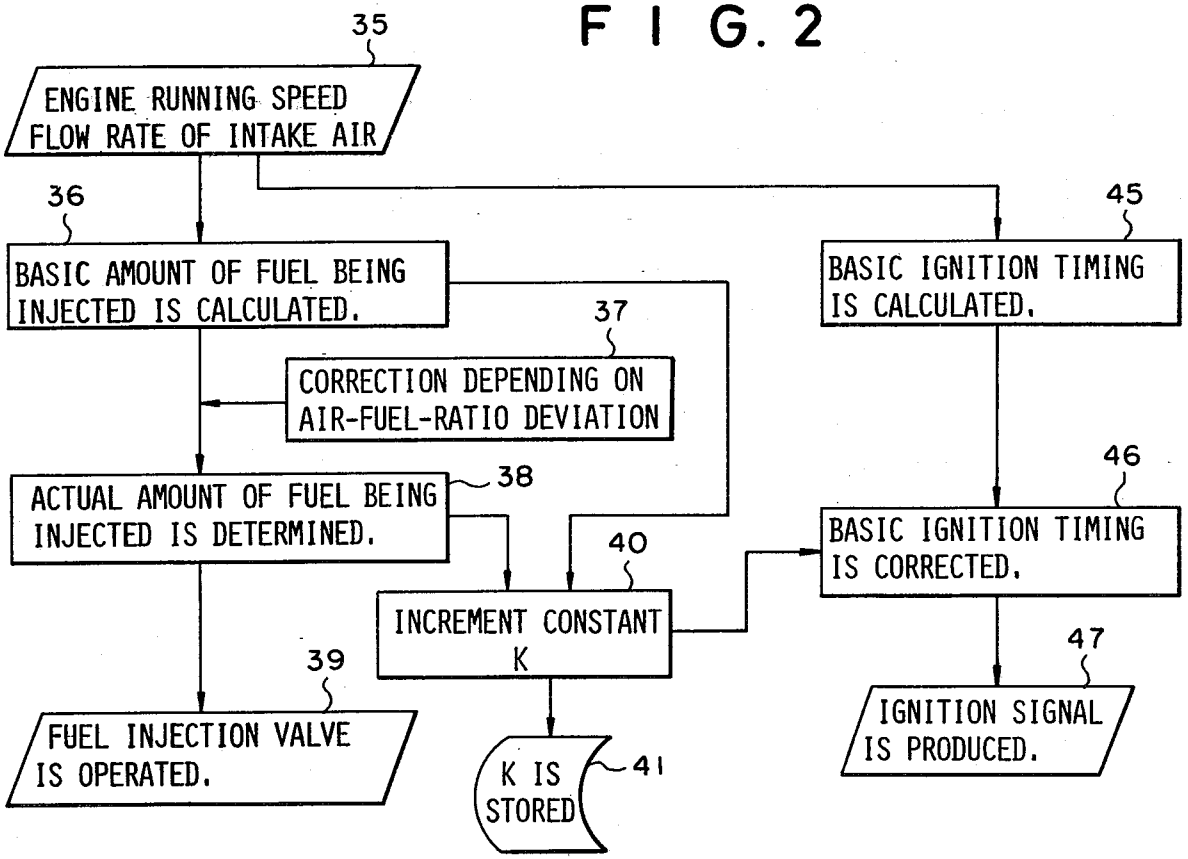
FIG. 2 is a flow chart for calculating an amount of fuel being injected and an ignition timing at the controlling of a close loop, wherein a basic amount of fuel being injected is calculated on the basis of air-fuel-ratio feedback signals.

FIG. 2 is a flow chart of the calculation process performed in the electronically controlling section 15 in closed loop controlling. At a step 35, operational parameters of the engine, such as an engine running speed and a flow rate of intake air, detected by respective sensors, are read in. At a step 36, a basic amount of fuel being injected is calculated according to the above-described operational parameters. At a step 37, the basic amount of fuel being injected is increased or decreased in relation to feedback signals of the air-fuel-ratio sensor 24. More in detail, if the air-fuel-ratio sensor 24 generates "lean" signals, the basic amount of fuel being injected is so corrected as to increase an actual amount of fuel being injected, and if the air-fuel-ratio sensor 24 generates "rich" signals, the basic amount of fuel being injected is so corrected as to decrease the actual amount of fuel being injected. At a step 38, a mean value of the actual amount of fuel injected for a predetermined duration is determined. At a step 39, the fuel injection valve 14 is operated according to the actual amount of fuel being injected thus determined. At a step 40, there is obtained a ratio of a mean value of the basic amount of fuel being injected for a given duration which has been calculated at the step 36 to a mean value of the actual amount of fuel being injected for a given duration which has been determined at the step 38, that is to say, an increment constant K (the actual amount of fuel being injected/the basic amount of fuel being injected). The constant K is stored in a memory at a step 41. A random access memory RAM for storing the constant K therein is connected to a backup power source, so as to hold therein the constant K even when the ignition switch for the engine has been turned off. At a step 45, a basic ignition timing is calculated, on the basis of operational parameters of the engine which have been obtained at the step 35. The basic ignition timing calculated at the step 45 is a minimum advance for best torque (MBT) in the case where a pure gasoline fuel is employed. At a step 46, the basic ignition timing is corrected according to the increment constant K obtained at the step 40. With increase in the increment constant, namely, with increase in a concentration of alcohol, an octane value increases, and an amount of nitrogen oxides decreases. In order to increase an engine output and decrease a fuel cost, an actual ignition timing makes earlier than the basic ignition timing. In order to determine the actual ignition timing from the basic ignition timing and the increment constant K, it is desirable that plural maps relating to degrees of corrected angle of advance, in which maps K is used as a parameter and the running speed and the amount of intake air are taken on the coordinates, are stored in ROM beforehand, and the degrees of corrected angle of advance thus obtained by the maps are added to or subtracted from the basic ignition timing, thereby determining the actual ignition timing. With due consideration for decreasing a quantity of memory, only a typical value of K used as a parameter is selected. This disadvantage, however, can be avoided by a known interpolation calculation. At a step 47, ignition signals are transmitted to an ignition coil 32, according to the actual ignition timing determined at the step 46. In the conventional, electronically controlling, fuel injection method, the basic ignition timing has been used as the actual ignition timing, without being corrected in relation to a concentration of alcohol in the fuel. In the method according to the present invention, the basic ignition timing is corrected in relation to a concentration of alcohol in the fuel as described above. The correction of the basic ignition timing increases an engine output in closed loop controlling, curtails a fuel cost and reduces an amount of harmful constitutents being released to atmosphere.

Figure 3:
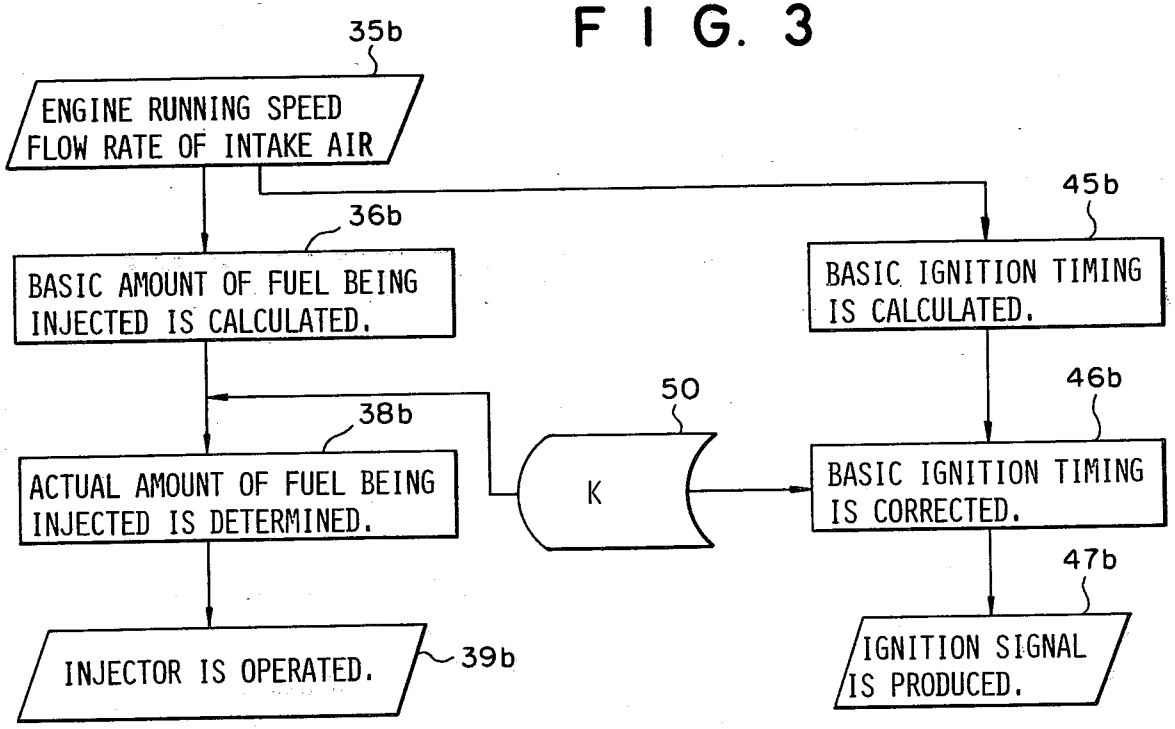
FIG. 3 is a flow chart of a controlling method for calculating an amount of fuel being injected and an ignition timing at the controlling of an open loop.

FIG. 3 is a flow chart of the method in open loop controlling in which an air-fuel-ratio-feedback signal is interrupted, such as during the warming-up of an engine and when the throttle valve assumes a fully open position. Steps corresponding to those in FIG. 2 are denoted by the same reference numerals with suffix b and no description is given thereto. At a step 50, the increment constant K stored at the step 41 is read in, and the actual amount of fuel being injected and the actual ignition timing are determined by multiplying by the increment constant K the basic amount of fuel injected and the basic ignition timing which have been calculated at the steps **36*b* and 45*b***, respectively.

Figure 4:
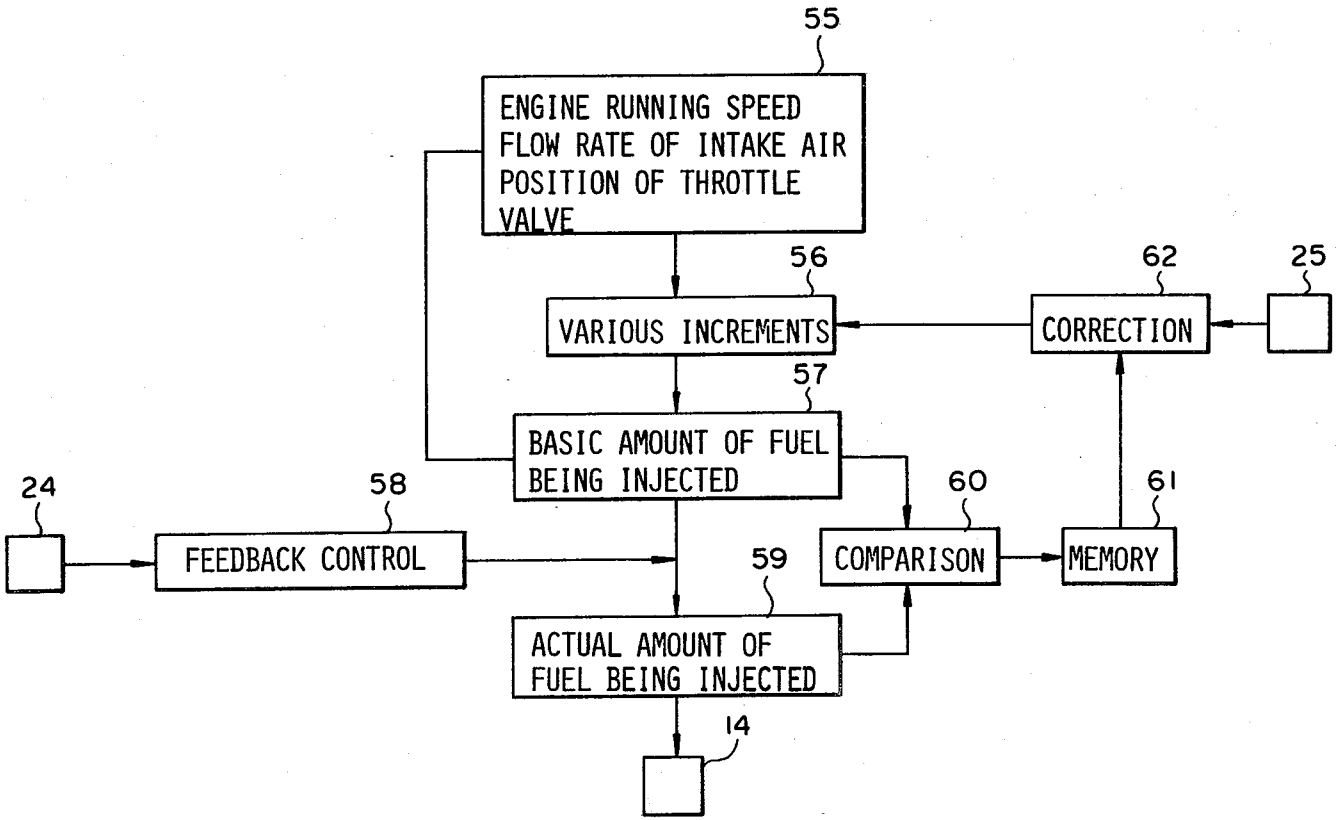
FIG. 4 is a flow chart of an electronically controlling method for calculating an amount of fuel being injected by using a concentration of alcohol as a parameter; and, FIG. 5 is a flow chart of an electronically controlling method for calculating an amount of fuel being injected and an ignition timing by using a concentration of alcohol as a parameter.

FIG. 4 is a flow chart of the controlling method different from that in the flow chart of FIG. 2, which is conducted in the electronically controlling section 15. At a step 55, parameters such as an engine running speed and an amount of intake air, and a position of the throttle valve are read in. At a step 56, the increment is calculated, taking into consideration a concentration of alcohol in the fuel, besides the above-described operational parameters. At a step 57, an amount of fuel being injected is calculated according to an amount of intake air and the engine running speed, and a basic amount of fuel being injected is calculated by adding the increment of fuel obtained at the step 56 to the amount of fuel being injected calculated. At a step 58, the basic amount of fuel being injected is corrected on the basis of feedback signals of the air-fuel-ratio sensor 24. When the air-fuel-ratio sensor 24 generates "lean" signals, the basic amount of fuel being injected is increased, and when the air-fuel-ratio sensor 24 generates "rich" signals, the basic amount of fuel being injected is decreased. Based on the correction described above, the actual amount of fuel being injected is determined at a step 59, and the fuel injection valve 14 is operated according to the actual amount of fuel being injected thus determined. At a step 60, a mean value of the actual amount of fuel being injected for a given duration at the step 59 is compared with a mean value of the basic amount of fuel being injected for the given duration at the step 57, whereby a difference K between these means values in closed loop controlling is obtained. The difference K is stored in RAM at a step 61. The RAM for storing the difference K therein is connected to a backup power source, so as to hold the memory therein even when the engine ignition switch is turned off. At a step 62, an output of the alcohol sensor 25 is corrected according to the difference K stored in RAM. If K is positive, namely, if a concentration of alcohol detected by the alcohol sensor 25 is lower than an actual concentration of alcohol and therefore the actual amount of fuel being injected which has been calculated at the step 59 is larger than the basic amount of fuel being injected which has been calculated at the step 57, then an output of the alcohol sensor is so corrected as to be shifted by an extent proportional to the value K or by a given value toward a higher concentration of alcohol, and if K is negative, namely, if a concentration of alcohol detected by the alcohol sensor 25 is higher than an actual concentration of alcohol and therefore the actual amount of fuel being injected which has been obtained at the step 59 is smaller than the basic amount of fuel being injected obtained at the step 57, then an output of the alcohol sensor is so corrected as to be shifted by an extent proportional to K or by a given value toward a lower concentration of alcohol. Or otherwise, correction at the step 62 may be such that a value related to K is used as a correction value, and the output of the alcohol sensor 25 is multiplied by the correction value. Thus, the concentration of alcohol employed for processing at the step 56 becomes substantially equal to the actual concentration of alcohol, despite fluctuation in output of the alcohol sensor, and the basic amount of fuel being injected on the basis of the actual concentration of alcohol is calculated at a step 57. During the warm-up of the engine or in open loop controlling such as when the throttle valve is at a fully open position, the feedback control at the step 58 is not effected, so that the actual amount of fuel being injected at the step 59 will be equal to the basic amount of fuel being injected obtained at the step 57. Correction at the step 62 is made according to the difference K stored in RAM in closed loop controlling, so that a proper air-fuel ratio is maintained even in open loop controlling, irrespective of fluctuation in an output of the alcohol sensor 25.

Figure 5:
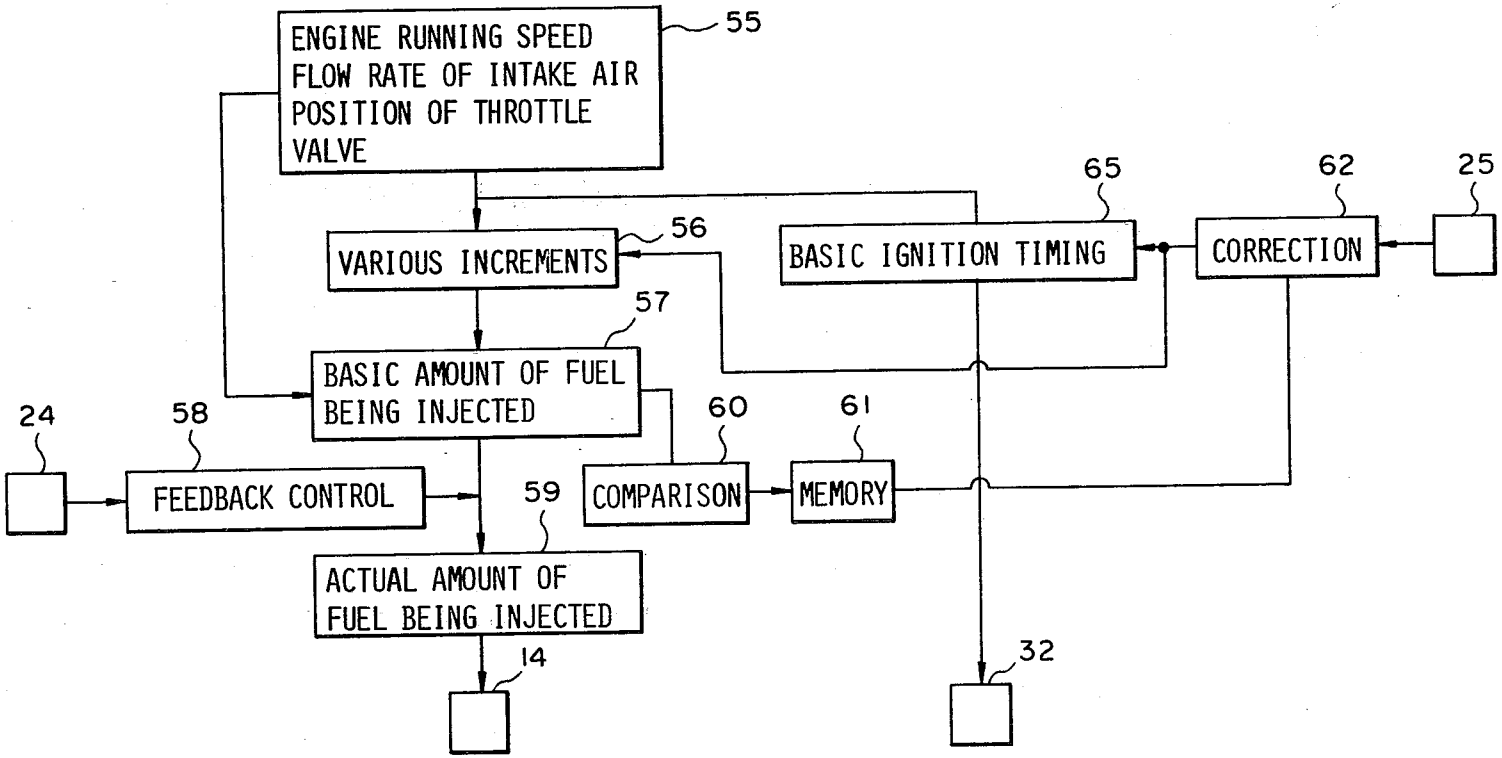

FIG. 5 is a flow chart of a controlling method according to a further example of this invention. Portions corresponding to those in FIG. 4 are denoted by the same reference numerals and no description is given thereto. At a step 65, a basic ignition timing is calculated according to operational parameters of an engine, such as an engine running speed, and a concentration of alcohol in a fuel. The basic ignition timing, as it remains intact, is used as an actual ignition timing, and a primary current is supplied to the ignition coil 32 at the basic ignition time. With increase in concentration of alcohol, an actane value increases, and an amount of nitrogen oxides being produced is decreased. In view of the above facts, the actual ignition timing makes earlier than the basic ignition timing, thereby increasing an engine output and curtailing a fuel consumption. The basic ignition timing is calculated according to a corrected output of the alcohol sensor made at the step 62, so that an air-fuel ratio is determined at a proper value related to an actual concentration of alcohol, independently of flunctuation in an output of the alcohol sensor 25.

What is claimed is:

1. In an electronically controlling, fuel injection method, wherein a gasoline fuel containing alcohol is supplied via an electromagnetic fuel injection valve into an intake system of an engine; comprising the steps of:

storing in a storage means a comparison value representing a comparison of a basic amount of fuel being injected and an actual amount of fuel being injected, in closed loop controlling, said basic amount of fuel being injected calculated on the basis of operational parameters of the engine, and said actual amount of fuel being injected being determined by correcting said basic amount of fuel being injected on the basis of air-fuel-ratio feedback signals, and wherein a basic ignition timing is calculated on the basis of operational parameters of the engine, and said basic ignition timing is corrected on the basis of said comparison value, whereby an actual ignition timing is obtained; and correcting said basic amount of fuel being injected on the basis of said comparison value, in open loop controlling, in order to determine an actual amount of fuel being injected.

2. An electronically controlling, fuel injection method as defined in claim 1, wherein in order to calculate a basic amount of fuel being injected, an engine running speed and a flow rate of intake air are selected as operational parameters of the engine.

3. An electronically controlling, fuel injection method as defined in claim 2, wherein said comparison value is stored in a means adapted for holding a memory therein even when an engine ignition switch has been turned off.

4. An electronically controlling, fuel injection method as defined in claim 3, wherein an actual amount of fuel being injected in open loop controlling is a value obtained by adding a given value to the basic amount of fuel being injected.

5. An electronically controlling, fuel injection method as defined in claim 1, wherein said basic ignition timing is a minimum advance for best torque in the case where a pure gasoline fuel is employed.

6. An electronically controlling, fuel injection method as defined in claim 5, wherein, with increase in a concentration of alcohol in a fuel, the actual ignition timing makes earlier than the basic ignition timing.

7. An electronically controlling, fuel injection method as defined in claim 5, wherein, with increase in a concentration of alcohol in a fuel, the actual ignition time makes later than the basic ignition timing.

8. An electronically controlling, fuel injection method as defined in claim 1 wherein said comparison value is the difference between a basic amount of fuel being injected and an actual amount of fuel being injected.

9. An electronically controlling, fuel injection method as defined in claim 8 wherein an actual amount of fuel being injected in open loop controlling is a value obtained by adding said difference to the basic amount of fuel being injected.

10. An electronically controlling, fuel injection method as defined in claim 1 wherein said comparison value is the ratio of the basic amount of fuel being injected to the actual amount of fuel being injected.

11. An electronically controlling, fuel injection method as defined in claim 10 wherein an actual amount of fuel being injected in open loop controlling is a value obtained by multiplying said basic amount of fuel being injected by said ratio.

* * * * *